US005081741A

United States Patent [19]

Aumercier

[11] Patent Number: 5,081,741

[45] Date of Patent: Jan. 21, 1992

[54] HINGE FITTINGS FOR PIVOTING AND TILTABLE DOORS, WINDOWS OR THE LIKE, SITUATED IN RABBETS OF THE OPENING FRAME AND THE FIXED FRAME

[75] Inventor: Laurent Aumercier, Phalsbourg, France

[73] Assignee: Ferco International Usine De Ferrures De Batiment, Sarrebourg, France

[21] Appl. No.: 409,890

[22] Filed: Sep. 20, 1989

[30] Foreign Application Priority Data

Oct. 11, 1988 [FR] France ..... 8813516

[51] Int. Cl.[5] ..... E05D 7/04; E05D 3/10; E05D 15/52

[52] U.S. Cl. ..... 16/238; 16/367; 49/192

[58] Field of Search ..... 16/238, 367; 49/192

[56] References Cited

U.S. PATENT DOCUMENTS 1,186,281 6/1916 Chasey ..... 16/367
3,838,537 10/1974 Stavenau et al. .
4,674,149 6/1987 Vetter .
4,692,964 9/1987 DeBruyn ..... 16/367

FOREIGN PATENT DOCUMENTS 112681 7/1984 European Pat. Off. .
2940049 5/1981 Fed. Rep. of Germany .
3601278 7/1987 Fed. Rep. of Germany .

OTHER PUBLICATIONS

European Search Report.
French Search Report.

*Primary Examiner*—Robert L. Spruill
*Assistant Examiner*—Carmine Cuda
*Attorney, Agent, or Firm*—Sandler, Greenblum & Bernstein

[57] ABSTRACT

Hinge fittings for pivoting a tiltable door or window in which the opening frame partially overlaps the fixed frame provided with a corner bearing and a casement stay fixed in rabbets, and each of the corner bearing and the casement stay having an auxiliary stay arm, a connecting rod and a second stay arm connecting the opening frame to the fixed frame. In order to guarantee better sealing and reliable operation of the door or window, the hinge fittings also include elements for the lateral and vertical positioning of the opening frame in relation to the fixed frame and elements to press the opening frame against the fixed frame on closing.

15 Claims, 2 Drawing Sheets

HINGE FITTINGS FOR PIVOTING AND TILTABLE DOORS, WINDOWS OR THE LIKE, SITUATED IN RABBETS OF THE OPENING FRAME AND THE FIXED FRAME

BACKGROUND OF THE INVENTION

1. Field of the Invention

The invention relates to hinge fittings for pivoting and tiltable doors, windows or the like in which the opening frame partially overlaps the fixed frame, consisting of a corner bearing and a casement stay fixed in rabbets and each comprising an auxiliary stay arm, a connecting rod, and a second stay arm, all hinged at one of their ends, and by means of a support, on to the bottom rail or top rail of the fixed frame, the opposite ends of the auxiliary stay arm and the second stay arm cooperating, either directly or by means of a principal stay, with the bottom rail and top rail respectively of the opening frame, the other end of the connecting rod being connected by means of a hinge to the said second stay arm.

2. Discussion of Background and Relevant Information

Hinge fittings corresponding to the above description are already known.

Those hinge fittings are used more particularly in the sphere of doors, windows or the like of the pivoting and tiltable type, comprising an opening frame provided on its periphery with a covering lip which in the closed position bears against the inner face of the fixed frame. This special feature of the opening frame, together with the fact that these hinge fittings are disposed in rabbets, means that at the start of the opening operation the opening frame has to be displaced beyond the fixed frame so that the covering lip does not hinder the functioning of the door, window or the like.

To this end, these hinge fittings comprise a corner bearing and a casement stay each provided with an auxiliary stay arm connected, on the one hand, to the bottom rail and the top rail, respectively, of the fixed frame, and, on the other hand, respectively, to the bottom rail of the opening frame and to a principal stay arm cooperating with the top rail of the opening frame.

The hinge fittings moreover comprise a second stay arm, slidably mounted at one of its ends on the bottom rail or top rail of the fixed frame, its other end being connected by means of a hinge to the bottom rail of the fixed frame or to the principal stay arm.

Finally, a connecting rod hinged at one of its ends on to the second stay arm, its other end being pivotally fixed on the bottom rail or top rail of the fixed frame, completes this corner bearing and this casement stay constituting the hinge fittings.

It will be noted that the various elements constituting the corner bearing and the casement stay are mounted on the bottom rail or the top rail of the fixed frame by means of a support in the form of an elongated metal plate or the like, comprising, in particular, a carriage in which one of the ends of the second stay arm is slidably mounted.

It would appear that doors, windows or the like provided with hinge fittings of this kind pose a number of problems, both with regard to sealing and with regard to the reliability of their operation.

It will be noted that the opening frame can only be pressed against the fixed frame by means of a locking system, such as a casement bolt or espagnolette lock, provided on the door or window. As this locking system is necessarily integrated into the front stile of the opening frame, it is only able to communicate pressure from the opening frame to the fixed frame at this front portion of the door or window.

Consequently, the force with which the opening frame bears against the fixed frame in order to guarantee good sealing depends only on the following parameters: manufacturing to particularly close tolerances of the various elements constituting the corner bearing and the casement stay, i.e. the auxiliary stay arm, the second stay arm and the connecting rod, and fitting and mounting the elements without play on the opening frame and the fixed frame.

However, strict compliance with these parameters leads to production costs that are not justified by the anticipated results.

It will be noted that the solution to the sealing problem and to the problems relating to the operation of a door or window provided with hinge fittings disposed in rabbets consists initially in perfecting the positioning of the opening frame in relation to the fixed frame by way of appropriate adjustment means not found in conventional hinge fittings. Moreover, there is good reason to eliminate the play that exists between the various components constituting the corner bearing and the casement stay in order to guarantee improved compression of the rear stile of the opening frame against the fixed frame.

A number of solutions have in fact been proposed, but they only partially resolve these problems.

In particular, it has been envisaged to provide the principal stay arm of the casement stay with a curved rear end in the form of a square, which, in the inwardly open position, covers the top corner of the opening frame. An opening is provided in the vertical side of this curved end, the opening being engaged by the projecting end of an operating rod actuated by the locking mechanism and, more particularly, by a casement bolt or espagnolette lock.

By virtue of this connection between the opening frame and the principal stay, situated in the immediate vicinity of the rear stile of the said opening frame, it is possible not only to fix the opening frame in the inwardly open position, but also to limit the play that exists between the opening frame and the principal stay. The most common solution, consisting of a catch fixed to the principal stay and cooperating with a locking member, such as a roller integral with an operating rod controlled by means of a casement bolt or espagnolette lock and housed in the upper edge of the opening frame, has the disadvantage that it creates a connection that is too far away from the rear stile of the door or window. Consequently, slight play in this connection will cause the opening frame to lock against the fixed frame at the rear stile, resulting in poor sealing.

It will be noted firstly that this solution does not actually solve the problem of the play that exists in the various mechanical connections between the elements constituting the corner bearing and the casement stay. Moreover, this solution does have other disadvantages which, although relating to different areas, still reduce the efficiency of these hinge fittings for pivoting and tiltable wings.

The curved rear end of the principal stay and its cooperation with the projecting end of an operating rod, in fact, result in additional space being occupied in the rabbets of the opening frame and the fixed frame.

Therefore, it is necessary to slot substantially the rear stile of either the said opening frame or the fixed frame.

In practice, it is advisable to avoid slots of this kind, as they not only reduce the resistance of the structure forming the door or window, but, moreover, do not correspond to standard manufacture, resulting in the necessity for the special manufacture of small-scale batches and additional stock control.

SUMMARY OF THE INVENTION

The object of this invention is to mitigate the aforementioned disadvantages. This problem is solved according to the invention as it is characterized in the claims by providing hinge fittings for pivoting and tiltable doors, windows or the like in which the opening frame partially overlaps the fixed frame, consisting of a corner bearing and a casement stay fixed in rabbets and each comprising an auxiliary stay arm, a connecting rod and a second stay arm, all hinged at one of their ends, by means of a support, on to the bottom rail or top rail of the fixed frame, the opposite ends of the auxiliary stay arm and the second stay arm cooperating, either directly or by means of a principal stay, with the bottom rail and top rail respectively of the opening frame, the other end of the connecting rod being connected by means of a hinge to the second stay arm. These hinge fittings moreover comprising, in combination, means for the lateral and vertical positioning of the opening frame in relation to the fixed frame and compression means for pressing the opening frame against the fixed frame.

The advantages obtained by virtue of this invention essentially consist in that the adjustment means associated with compression means for pressing the opening frame against the fixed frame on closing ensure good sealing of the door or window without this result being achieved at the expense of increased manufacturing and machining costs.

Another advantage consists in that the adjustment means, like the means for pressing the opening frame against the fixed frame, are fitted into rabbets of the door or window, thus reducing the amount of space occupied and preventing the necessity for any additional slotting of the opening frame or closed frame.

In addition, it will be noted that by virtue of their specific design, the compression means for pressing the opening frame against the fixed frame make it possible to compensate for the play that normally exists at the various components constituting the casement stay and the corner bearing.

BRIEF DESCRIPTION OF THE DRAWINGS

One embodiment of the invention will now be described in more detail with reference to the accompanying drawings, in which.

DETAILED DISCUSSION OF THE PREFERRED EMBODIMENTS

Figure 1:
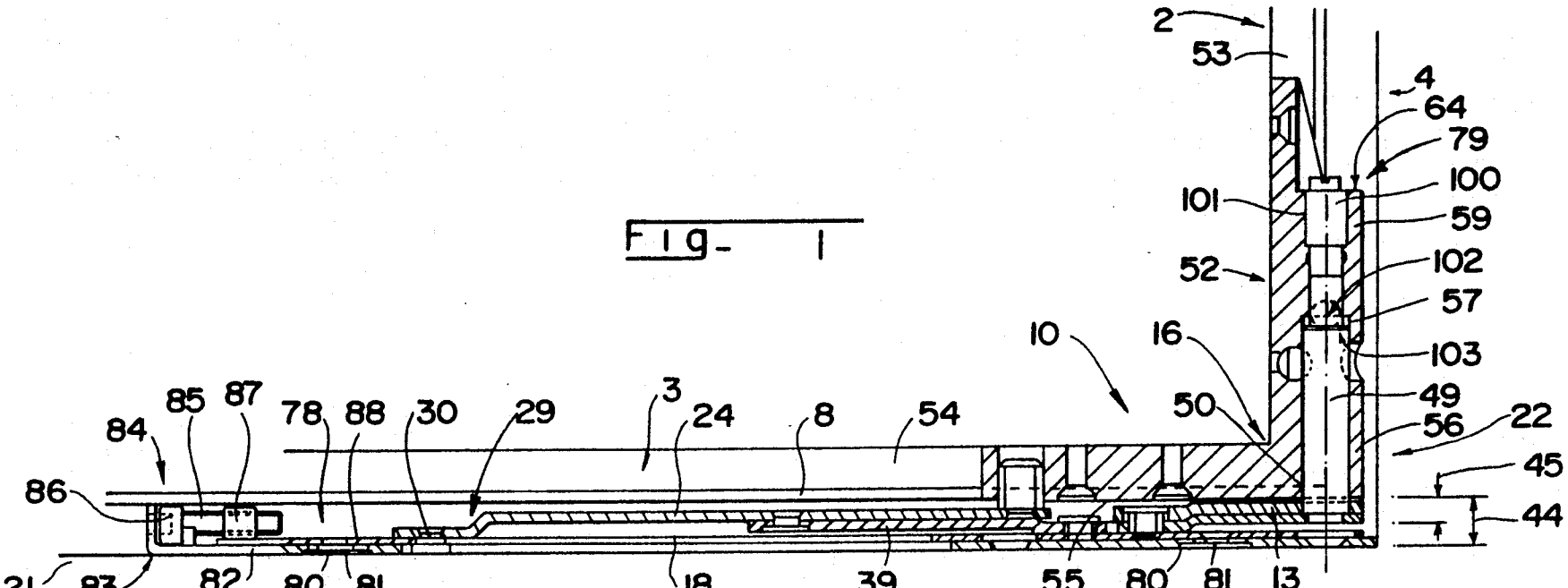
FIG. 1 shows a schematic elevational and sectional view of a corner bearing realized according to the invention.

This invention relates to hinge fittings for use, more particularly, in the sphere of pivoting and tiltable doors, windows or the like in which the opening frame partially overlaps the fixed frame.

These hinge fittings include a corner bearing 10 for the lower connection of the wing to the fixed frame 4 and a casement stay 11 forming the upper connection between the wing and fixed frame. The corner bearing 10 also allows the wing 1 to rotate about a vertical axis and also about a horizontal axis, while the casement stay 11 ensures that the principal stay 12 can pivot about a vertical axis, and as this principal stay 12 is connected to the wing 1, it transmits this rotation thereto. This casement stay 11 moreover makes it possible to limit the pivot angle of the wing 1 when it rotates about the horizontal axis.

Figure 2:
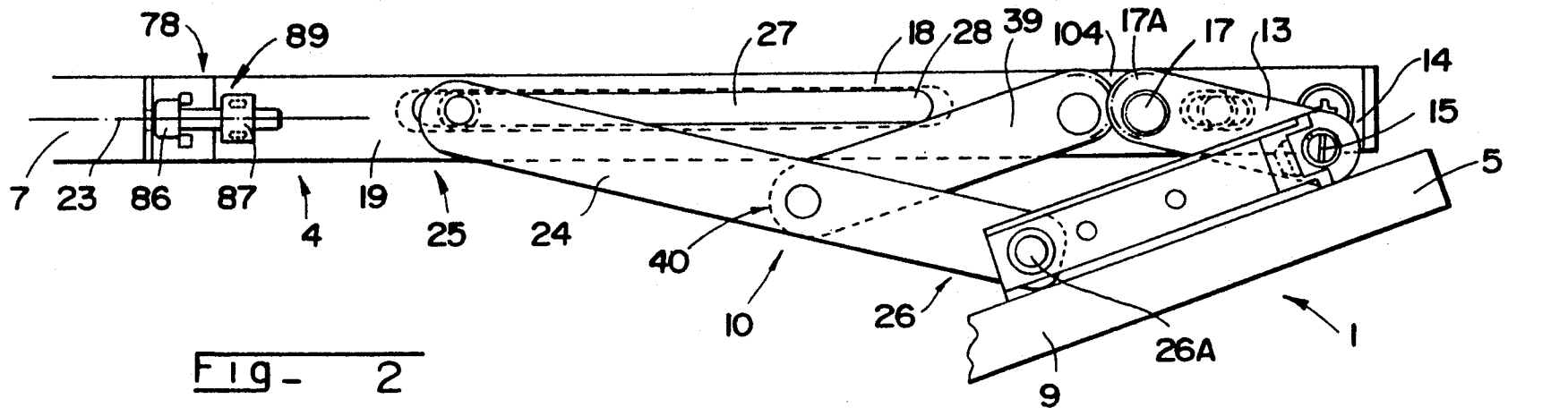
FIG. 2 shows a schematic plan view of the corner bearing illustrated in FIG. 1, the wing being in the inwardly open position.

The corner bearing 10 illustrated in FIGS. 1 and 2 comprises, on the one hand, an auxiliary stay arm 13 connected at one of its ends 14, and with the aid of hinge means 15, to the bottom rail 3 of the opening frame 9. This connection between the auxiliary stay arm 13 and the wing 1 is preferably situated as close as possible to the bottom corner 16 of the wing. A hinge 17 connects the auxiliary stay arm 13 at its end 17A to the fixed frame 4, and in particular, to a support 18 in the form of an elongated plate 19 disposed on the bottom rail 21 of the fixed frame 4.

During inward opening, this auxiliary stay arm 13 can release the rear stile 2 of the wing 1 from the rear stile 22 of the frame 4 and, simultaneously, can displace the wing 1 in a direction perpendicular to the vertical plane 23 of the door or window, this displacement preferably being towards the interior of the dwelling.

It is advisable to note that because the hinge fittings are disposed in rabbets, it is essential that the kinetics of a wing partially overlapping the fixed frame 4 are such that otherwise its peripheral edge 5 would cooperate with the inner face of the fixed frame 4, thus preventing its rotation about a vertical axis, and thus preventing inward opening.

The corner bearing 10 secondly comprises a second stay arm 24 connecting the opening frame 9 to the fixed frame 4. More precisely, this stay arm 24 is slidably mounted at one of its ends 25 on the bottom rail 21 of the fixed frame 4, while the other end 26 is fixed by means of a hinge 26A in a rabbet 8 and on the bottom rail 3 of the opening frame 9.

The slidable mounting of this second stay arm 24 on the fixed frame 4 is obtained by means of a carriage 27 provided in the support 18 fitted to the bottom rail 21 of the fixed frame 4. This carriage 27, in fact, consists of an oblong opening 28 provided in the plate 19, and, in particular, in its front portion 29 directed, towards the front stile of the fixed frame 4, the opening 28 is engaged by a pivot pin 30 fixed to the end 25 of the second stay arm 24.

The corner bearing 10 is also provided with a connecting rod 39 hinged at one of its ends 40 on to the second stay arm 24 and cooperating by means of a hinge, and at its opposite end 42, with the support 18 or plate 19. The principal function of this connecting rod 39 is to distribute the action of the stay arms 13 and 24 over the wing 1.

The second stay arm 24 is curved at its end 25 for the insertion of the connecting rod 39 between the second stay arm 24 and the plate 19, in the closed position of the wing 1. However, it must be ensured that the overall thickness 44 of the corner bearing 10 is always less than the play that exists between the rabbets 7, 8 of the fixed frame 4 and the opening frame 9 in order to prevent the necessity for slotting of either frame.

The auxiliary stay arm 13, which in the closed position of the wing 1, forms a continuation of the second stay arm 24 and the connecting rod 39, will have a thickness 45 equal to the sum of these components. This auxiliary stay arm 13, when reinforced in this manner, can support the weight of the wing 1 when it is brought outside the vertical plane 23 of the door or window.

Figures 3, 4, 5, 6:
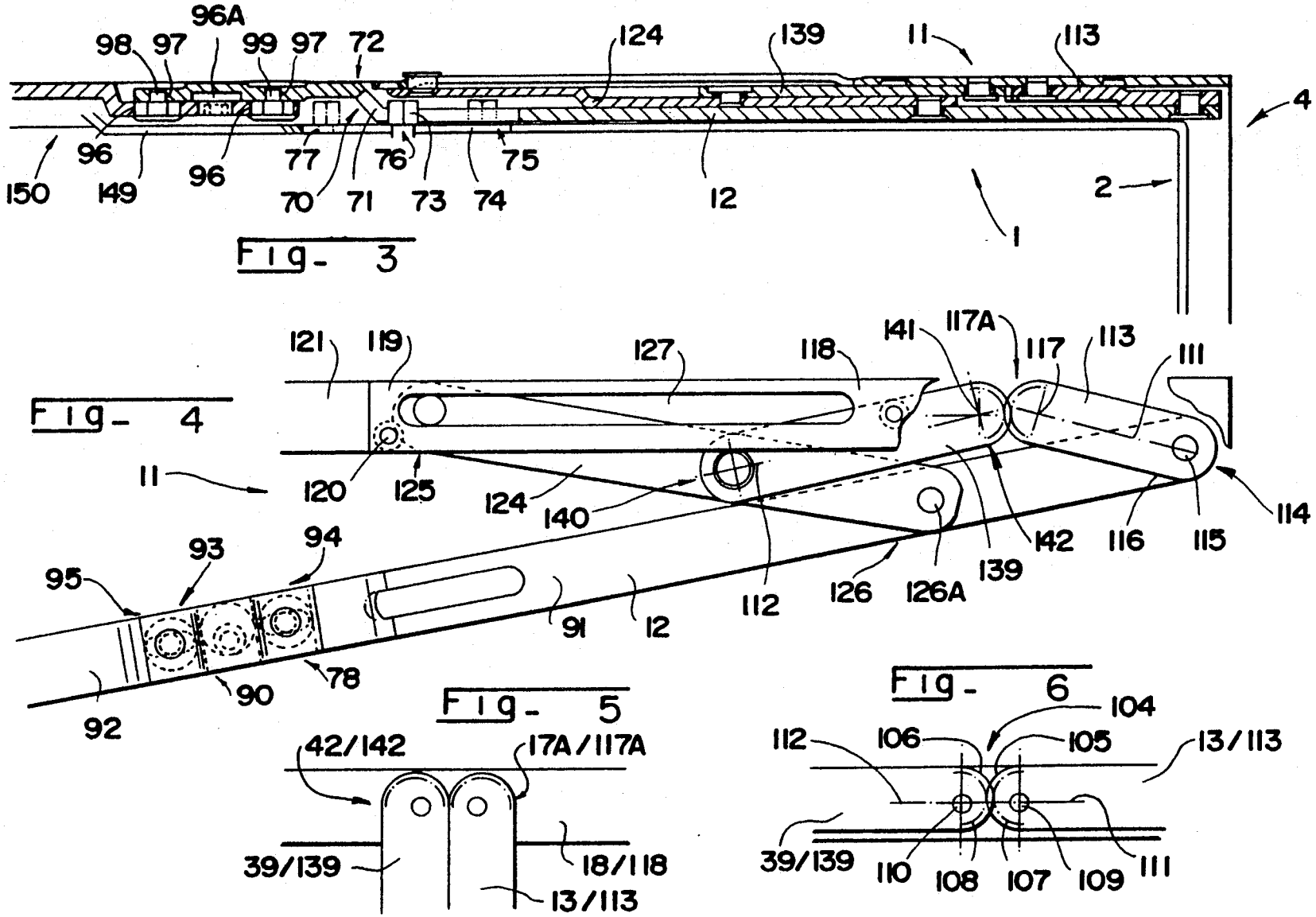
FIG. 3 shows a schematic section of a casement stay according to the invention, the opening frame being in the inwardly open position.
FIG. 4 shows a schematic plan view of the casement stay illustrated in FIG. 1.
FIG. 5 shows a schematic plan view of the arrangement of the connecting rod and the auxiliary stay arm of the casement stay or of the corner bearing when the door or window is opened inwardly to its maximum degree, and, FIG. 6 shows a view identical to that of FIG. 3, but with the opening frame of the door or window being closed on the fixed frame.

The casement stay 11, except for the principal stay 12, has a structure substantially identical to that of the corner bearing 10. Therefore, as illustrated in FIGS. 3 and 4, it comprises an auxiliary stay arm 113 connected at one of its ends 114 and by means of a hinge 115 to the rear end 116 of the principal stay 12. Moreover, a hinge 117 connects this auxiliary stay arm 113, at its opposite end, to a support 118 in the form of an elongated plate 119 made integral, by means of fixing elements 120 in the rabbet 7, with the top rail 121 of the fixed frame 4.

This casement stay 11 is also provided with a second stay arm 124 slidably mounted at one of its ends 125 in a carriage 127 provided in the support 118. The other end 126 of this second stay arm 124 is made integral with the principal stay 112 by means of a hinge 126A. In addition, a connecting rod 139, hinged at one of its ends 140 on to the second stay arm 124, also connects the second stay arm to the top rail 121 of the fixed frame 4.

The principal stay 12 is for its part connected to the wing 1 using techniques known to the man skilled in the art. Therefore, the front end is provided with a pivot pin (not shown) slidably mounted in an opening provided in a fore-end 149 disposed in a rabbet 8 on the top rail 150 of the opening frame 9. More precisely, this fore-end 149 covers a groove 150 formed in the periphery of the wing 1 and in which slide operating rods actuated by a locking mechanism, such as a casement bolt or espagnolette lock. In addition, a connecting rod (not shown) connects the principal stay 12 to the opening frame 9, preventing displacement of with the opening frame in relation to the fixed frame 4 in the case of tilted opening.

The principal stay 12 is held on the fore-end 149 in the inwardly open position by means of a catch 70 integral with the principal stay 12. According to the preferred embodiment of this invention, this catch 70 consists of an oblong opening 71 formed in the principal stay 12 at a curve 72 in the latter, situated, in the closed position of the door or window, in front of the plate 119. This catch 70 or oblong opening 71 is engaged by a locking member 73, such as a roller, fixed on an operating rod and emerging from the fore-end 149 through an opening 74 provided for this purpose.

FIG. 3 illustrates the locking member 73 in three distinct positions 75, 76, 77, corresponding to different methods of opening and to the closed position of the door or window. Therefore, in the position marked 75, the locking member 73, indicated by a broken line, completely engages the catch 70, the door or window then being locked. In its mid position 76 (indicated by a continuous line), the locking member 73 partially engages the oblong opening 71, fixing the principal stay 12 in relation to the opening frame 9, which can pivot about its vertical axis of rotation corresponding to inward opening. Finally, in the position marked 77, the locking member 73, indicated by a broken line, emerges from the catch 70 owing to the curve 72 provided in the principal stay 12 and releases the latter in order to allow tilted opening.

The opening frame 9 can pivot about a horizontal axis in relation to the fixed frame 4 because there is sufficient play at the hinge 17 connecting the auxiliary stay arm 13 to the support 18.

The hinge means 15 connecting this same auxiliary stay arm 13 to the wing 1 consist of a vertical axis 49 made integral at its lower end 50 with the free end 14 of the auxiliary stay arm 13. In addition, a square 52 covers the bottom corner 16 of the wing 1 and enters into slots 53, 54 provided in the rear stile 2 of the bottom rail 3 of the wing 1, with the slots 53, 54 usually serving to house the operating rods and the fore-end. This square 52 is made integral with the wing 1 by means of fixing elements, such as screws or the like, and comprises in its lower edge 55 and in the corner 56 a cylindrical recess 57 having dimensions adapted to those of the axis 49 to allow for the passage and rotation of the latter.

According to the invention, the hinge fittings for pivoting and tiltable doors or windows moreover comprise means 78, 79 for the lateral and vertical positioning of the opening frame 9 in relation to the fixed frame 4. The essential function of positioning means of this kind is to compensate for any displacement of the opening frame 9 in relation to the fixed frame 4 as a result of the usual manufacturing tolerances of these frames or of the components constituting the hinge fittings.

Consequently, it is possible to achieve better sealing of the door or window.

The means 78 for the lateral positioning of the opening frame 9 in relation to the fixed frame 4 consist, at the corner bearing 10, of a sliding connection 80 connecting the support 18 or plate 19 to the bottom rail 21 of the said fixed frame 4, the sliding end of the second stay arm 24 and the ends 17A and 42 respectively of the auxiliary arm 13 and the connecting rod 39 being fixed on the plate 19.

More precisely, the support 18 is slidably mounted, by means of fixing members 81, such as screws or rivets, on a fixed support 82 permanently fixed on the bottom rail 21 of the fixed frame 4. Moreover, this fixed support 82 comprises in its front portion 83, adjustment means 84 cooperating with the support 18 to control its displacement.

According to a preferred embodiment, these adjustment means 84 consist of an adjusting screw 85 whose head 86 is fixed in translation on the fixed support 82, this adjusting screw 85 moreover cooperating with a nut 87 attached to the upper face 88 and at the front end 89 of the support 18, referred to in the remainder of the description as the moving support.

Therefore, when the said adjusting screw 85 is actuated, the fixing members 81 having been loosened in advance, the moving support 18 can be displaced longitudinally in relation to the fixed support 82 and, simultaneously, the bottom rail 3 of the wing 1 can be positioned laterally in relation to the fixed frame 4.

It is of course clear that the lateral positioning means 78, limited to adjustment means 85 of this kind associated with the corner support 10, would not allow perfect adjustment of the opening frame 9 in relation to the fixed frame 4. Therefore, the lateral positioning means 78 are completed by a casement stay 11 comprising a principal stay 12 of variable length.

More precisely, this principal stay 12 is further divided, substantially at its center 90 and beyond the curve 72, into two distinct portions 91, 92 connected to one another by means of a sliding connection 93, so that it is possible to vary the total length of the principal stay 12.

Therefore, according to a preferred embodiment, the front end 94 of the rear portion 91 overlaps the rear end 95 of the front portion 92. Openings 96, 97 formed in these front and rear ends 94 and 95 respectively of the rear and front portions 91 and 92 respectively serve for the passage of connecting members 98, 99, such as screws, rivets or the like. The openings 96 provided in the rear end 95 of the front portion 92 are advantageously oblong, so that said front portion can slide in relation to the said connecting members 98, 99, i.e. in relation to the rear portion 91 of the principal stay 12. The length of the principal stay is adjusted by acting on an eccentric screw 96A disposed between the connecting members 98, 99 and connecting the rear portion 91 to the front portion 92.

The means 79 for positioning the opening frame 9 in a vertical direction in relation to the fixed frame 4 are preferably associated with the corner bearing 10.

These means in fact consist of an adjusting screw 100 introduced into a threaded bore 101 provided in the upper edge 64 of the vertical side 59 corresponding to the square 52 covering the bottom corner 16 of the wing 1. This threaded bore 101 opens into the cylindrical recess 57 into which is introduced the vertical axis 49 of the hinge means 17 connecting the auxiliary stay 13 to the fixed frame 4. Therefore, the lower end 102 of the adjusting screw 100 can bear against the upper end 103 of the vertical axis 49 and can convert its rotation into vertical displacement of the wing 1.

However, the sealing of a door or window does not depend solely on good positioning of the opening frame 9 in relation to the fixed frame 4, but also on the pressure with which the opening frame 9 bears against the fixed frame 4 when closed. It is for this reason that the hinge fittings forming the object of this invention comprise, in combination, the said positioning means 78, 79 and compression means 104 for pressing the opening frame against the fixed frame 4.

According to a preferred embodiment, these compression means 104 consist of close cooperation during closing between the auxiliary stay arm 13, 113 and the connecting rod 39, 139 at the corner bearing 10 and/or the casement stay 11, so that the angular displacement of the one is accompanied by rotation of equivalent amplitude by the other.

More precisely, the ends 17A, 117A and 42, 142 of the auxiliary stay arm 13, 113 and the connecting rod 39, 139; respectively of the corner bearing 10 and the casement stay 11, on their ends 17A, 117A and 42, 142 hinged on to the support 18, 118, comprise on their semicircular peripheries 105, 106 teeth 107, 108 progressively meshing with one another as the wing 1 closes on the fixed frame 4.

This progressive cooperation of the teeth 107, 108 of the auxiliary stay arm 13, 113 and the connecting rod 39, 139 is advantageously obtained by bringing the axis 109, 110 of the hinge connecting the auxiliary stay arm 13, 113 and the connecting rod 39, 139 to the support 18, 118 out of center in relation to the longitudinal mid plane 111, 112 of the auxiliary stay arm and the connecting rod. This off-centering is moreover effected in such a way that, in the open position of the door or window corresponding to the position of the connecting rod 39, 139 and the auxiliary arm 13, 113 which can be seen in FIG. 5, the teeth 107, 108 of connecting rod and the auxiliary arm are released from one another, and that, on the other hand, in the closed position shown in FIG. 6, the ends 17A, 117A and 42, 142 of the auxiliary arm 13, 113 and the connecting rod 39, 139 move closer together, resulting in the cooperation of the teeth 107, 108.

The advantage of the compression means 104 realized according to the embodiment described hereinabove essentially consists in that the play that exists between some of the components constituting the corner bearing 10 and the casement stay 11 is compensated for, thus greatly improving their efficiency and increasing the force with which the wing 1 bears against the fixed frame 4.

Therefore, the action of the locking system, such as a casement bolt or espagnolette lock, on the front stile of the opening frame 9 on closing, is completely transmitted by means of the connecting rod 39 , 139 and the auxiliary stay arm 13, 113 to the rear stile 2 of the wing 1.

On the other hand, the relative independence that the connecting rod 39, 139 achieves in relation to the auxiliary stay arm 13, 113 during opening of the door or window means that said door or window can be given a greater amplitude of angular displacement.

It is certain that under these conditions this invention unquestionably perfects the hinge fittings known in the prior art.

I claim:

1. Hinge fittings for pivoting a tiltable member in which an opening frame partially overlaps a fixed frame, comprising:

a corner bearing;

a casement stay;

each of said corner bearing and said casement stay being fixed in a rabbet and including an auxiliary stay arm, a connecting rod and a second stay arm;

each of said auxiliary stay arm, said connecting rod and said second stay arm having two ends, with one end being hingedly connected by a hinge connection on a support to at least one of a bottom rail and a top rail of the fixed frame, the other end of said auxiliary second arm and said second stay arm cooperating with at least one of a top rail or a bottom rail of the opening frame and the other end of said connecting rod being hingedly connected by a hinge connection to said second stay arm;

adjustable positioning means for adjustable lateral and vertical positioning of the opening frame in relation to the fixed frame; and compression means for pressing the opening frame against the fixed frame.

2. The hinge fittings according to claim 1, wherein said second stay arm cooperates directly with at least one of the bottom rail and the top rail of the opening frame.

3. The hinge fittings according to claim 1, wherein said second stay arm cooperates via a principal stay with at least one of the bottom rail and the top rail of the opening frame.

4. The hinge fittings according to claim 1, wherein said adjustable positioning means comprise at said corner bearing a sliding connection connecting said support to the bottom rail of the fixed frame.

5. The hinge fittings according to claim 1, wherein said support is slidably mounted on a fixed support that is permanently affixed to the bottom rail of the fixed frame, and said adjustable positioning means including, on a front portion of said fixed support, means for adjustment cooperating with said support to control its longitudinal displacement and to displace the opening frame laterally in relation to the fixed frame.

6. The hinge fittings according to claim 5, wherein said means for adjustment comprise an adjusting screw having a head that is fixed in translation on said fixed support and cooperating with a nut attached to an upper front face and at the front end of said support.

7. The hinge fittings according to claim 1, wherein said second stay arm of said casement stay cooperates via a principal stay wtih the top rail of the opening frame, and said adjustable positioning means include means for adjusting the length of said principal stay to thereby permit lateral positioning of the opening frame in relation to the fixed frame.

8. The hinge fittings according to claim 7, wherein said means for adjusting the length of said principal stay include said principal stay being divided into two portions connected to one another by a sliding connection.

9. The hinge fittings according to claim 8, wherein said principal stay is divided substantially at its center.

10. The hinge fittings according to claim 8, further including means forming openings on each of said two portions of said principal stay serving for passage of connecting members and an eccentric screw in order to vary the length of said principal stay.

11. The hinge fittings according to claim 1, wherein said adjustable positioning means comprise at said corner bearing a vertical axis, said vertical axis having a lower end which is integral with the other end of said auxiliary stay arm and engaging a cylindrical recess formed in a lower edge and in a corner of a square at a bottom corner of the opening frame, an adjusting screw in a threaded bore in an upper edge of said cylindrical recess, said adjusting screw cooperating at its lower end with an upper end of said vertical axis within said cylindrical recess.

12. The hinge fittings according to claim 1, wherein said compression means include means for interaction between said auxiliary stay arm and said connecting rod for at least one of said corner bearing an said casement stay, so that angular displacement of one of said auxiliary stay arm and said connecting rod causes equivalent rotation of the other.

13. The hinge fittings according to claim 12, wherein said means for interaction comprise teeth on semi-circular peripheries on adjacent ends of said auxiliary stay arm and said connecting rod which are hingedly connected to said support, the hinge connection on said support for each of said auxiliary stay arm and said connecting rod including an axis positioned outside of a longitudinal mid plane of each of said auxiliary stay arm and said connecting rod, so that said teeth are capable of progressively meshing wtih one another as the opening fame closes on the fixed frame.

14. The hinge fittings according to claim 1 in combination with a tiltable member.

15. The combination according to claim 14, wherein said tiltable member comprises a door or window.

* * * * *